US005857391A

United States Patent [19]

Renström

[11] Patent Number: 5,857,391

[45] Date of Patent: Jan. 12, 1999

[54] DEVICE FOR CUTTING A PROTECTIVE LAYER AWAY FROM A MATERIAL ROLL

[75] Inventor: Mikael Renström, Sätinge, Sweden

[73] Assignee: NDC Netzler & Dahlgren Co. AB, Saro, Sweden

[21] Appl. No.: 693,372

[22] Filed: Aug. 5, 1996

Related U.S. Application Data

[63] Continuation of Ser. No. 295,690, filed as PCT/SE93/00160 Feb. 26, 1993 published as WO93/17946 Sep. 16, 1993, abandoned.

[30] Foreign Application Priority Data

Mar. 2, 1992 [SE] Sweden ..... 9200625
Sep. 21, 1992 [SE] Sweden ..... 9202712

[51] Int. Cl.[6] ..... B23B 5/08

[52] U.S. Cl. ..... 82/10.1; 82/10.1; 82/90; 414/25; 53/492

[58] Field of Search ..... 82/101, 90; 414/541, 414/637, 662, 663, 666, 672, 910, 911; 53/492, 381.2, 381.4; 83/856, 924

[56] References Cited

U.S. PATENT DOCUMENTS

| | | | |
|---|---|---|---|
| 4,161,253 | 7/1979 | Ralston et al. | 414/911 X |
| 4,534,151 | 8/1985 | Schneck et al. | 82/101 X |
| 4,541,316 | 9/1985 | Fuminier | 82/101 X |
| 4,821,971 | 4/1989 | Watanabe et al. . | |
| 4,854,806 | 8/1989 | Gertsch et al. | 414/910 X |
| 4,863,335 | 9/1989 | Herigstad et al. . | |
| 4,941,798 | 7/1990 | Meier | 414/910 X |
| 4,948,060 | 8/1990 | Kurz et al. . | |
| 5,060,456 | 10/1991 | Wehrli | 82/101 X |

FOREIGN PATENT DOCUMENTS

| | | | |
|---|---|---|---|
| 0 524 828 A1 | 1/1993 | European Pat. Off. . | |
| 1274848 | 11/1960 | France | 414/911 |
| 23 37 663 | 2/1975 | Germany . | |
| 28 12 829 | 11/1978 | Germany . | |
| 139323 | 5/1989 | Japan | 53/381.2 |
| 139324 | 5/1989 | Japan . | |
| 139325 | 5/1989 | Japan | 53/381.2 |
| 62-295785 | 5/1989 | Japan . | |
| 62-296727 | 5/1989 | Japan . | |
| 62-296728 | 5/1989 | Japan . | |
| 2-269628 | 11/1990 | Japan . | |
| 2-269629 | 11/1990 | Japan . | |

*Primary Examiner*—Andrea L. Pitts
*Assistant Examiner*—Henry W. H. Tsai
*Attorney, Agent, or Firm*—Adams Law Firm, P.A.

[57] ABSTRACT

Device for cutting a protective layer away from a material roll of web-formed material, comprising a rotation device which rotates the roll. The rotation device includes at least two rotatable carrier rollers, on which the material roll is supported and is rotated. In this way the protective layer on the material roll is cut away from the roll during a cutting operation by a cutting tool device. This contacts the roll during its rotation. The rotatable carrier rollers form lifting and carrying devices on a mobile load carrier in order to support the material roll whilst rotating it during the cutting operation and in order to transport the material roll to and, respectively, from a chosen place for the cutting operation.

1 Claim, 2 Drawing Sheets

DEVICE FOR CUTTING A PROTECTIVE LAYER AWAY FROM A MATERIAL ROLL

This application is a continuation of application Ser. No. 08/295,690, filed as PCT/SE93/00160 Feb. 26, 1993 published as WO93/17946 Sep. 16, 1993, now abandoned, which is a national stage application, according to Chapter II of the Patent Cooperation Treaty. This application claims the priority date of Mar. 2, 1992 for Swedish Patent Application No. 9200625-3 and the priority date of Sep. 21, 1992 for Swedish Patent Application No. 9202712-7.

TECHNICAL FIELD

The present invention relates to a device for cutting a protective layer away from a material roll of web-formed material, comprising a rotation device intended to rotate the roll, whereby the rotation device includes at least two rotatable carrier rollers, on which the material roll is supported and is arranged to rotate, whereby the protective layer on the material roll is cut away from the roll during a cutting operation by means of a cutting tool which is arranged to contact the roll during its rotation.

For transport and storage of material rolls comprising web-formed material, for example paper, these are provided, in connection with manufacture, with a packaging in form of one or more protective layers on the end faces of the roll or covering layers of a strong material, for example coarse paper. Before the roll of web-formed material contained in the packaging is used, e.g. in the graphics industry, packaging industry etc., the protective layer is removed before the web material can be unrolled.

STATE OF THE ART

It is known in the art to remove the protective layer from material rolls by the material roll being transported to a station for so-called roll-stripping, whereby the roll is normally transported by means of a truck, unloaded to a rotation device at the station and whereupon by means of a knife the packaging is cut open during rotation of the roll. After removal of the packaging the material roll is again loaded onto a suitable load carrier for further transport to a following station for unrolling of the web-formed material. The actual removal of the protective layer is a relatively fast procedure, whilst the total procedure is however lengthened unfavourably by an unloading procedure both before and after the removal of the protective layer.

The object of the present invention is to facilitate the procedure with removal of the protective layer from material rolls.

SUMMARY OF THE INVENTION

Said object is achieved by means of a device according to the present invention, which is characterized in that said rotatable carrier rollers form lifting and carrying means on a mobile load carrier in order to support the material roll whilst rotating it during the cutting operation and to transport the material roll to and, respectively, from a chosen place for the cutting operation.

DESCRIPTION OF THE FIGURES

The invention will be described more closely with reference to an embodiment and to the accompanying drawings, in which.

DESCRIPTION OF PREFERRED EMBODIMENT

Figure 1:
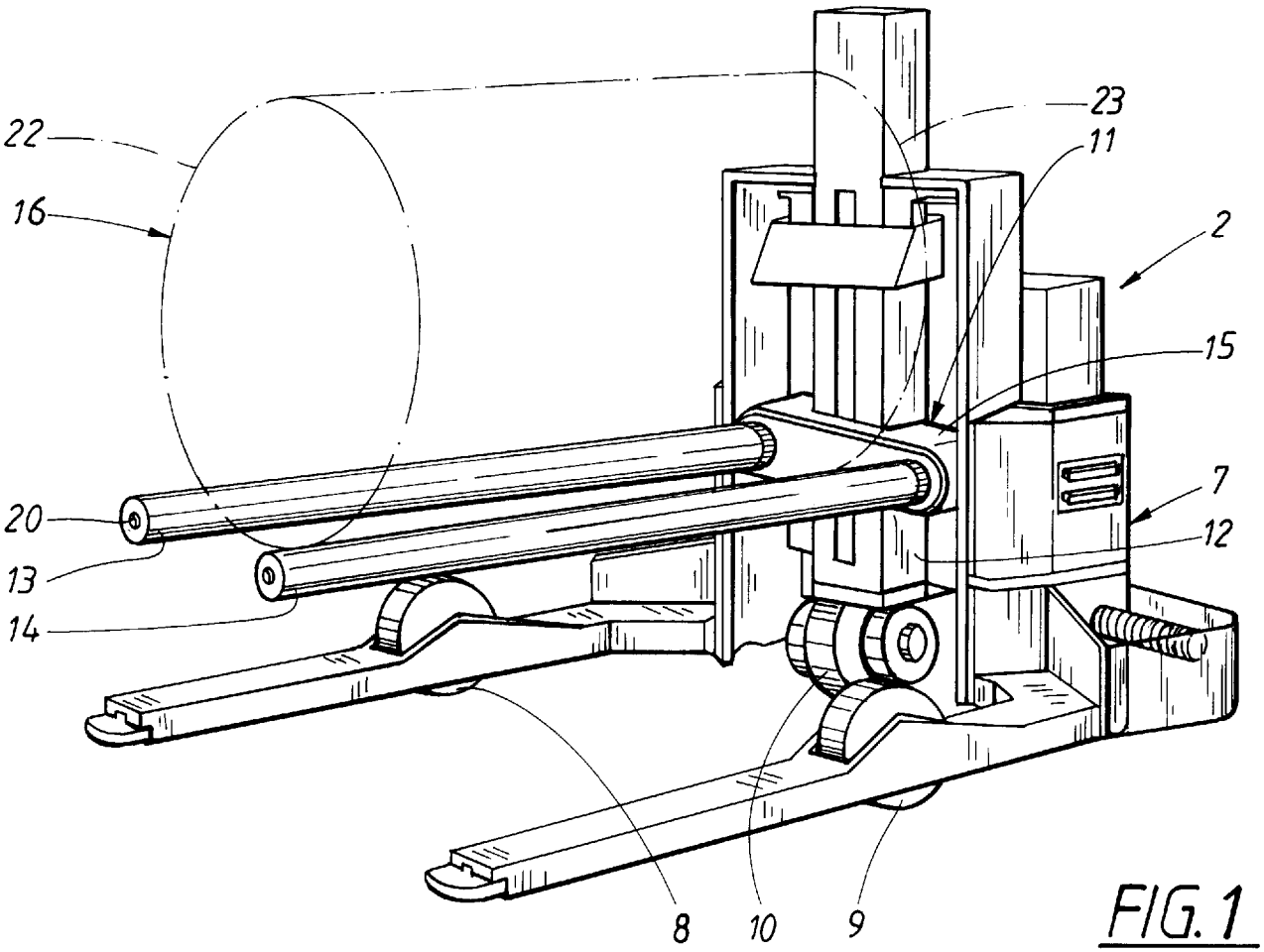
FIG. 1 shows a perspective view of the arrangement according to the invention, whilst FIG. 2, in an end view, shows a particular embodiment with a stationary part as well as the mobile parts shown in FIG. 1 of the device in a position for cutting away the protective layer from a material roll.
Figure 2:
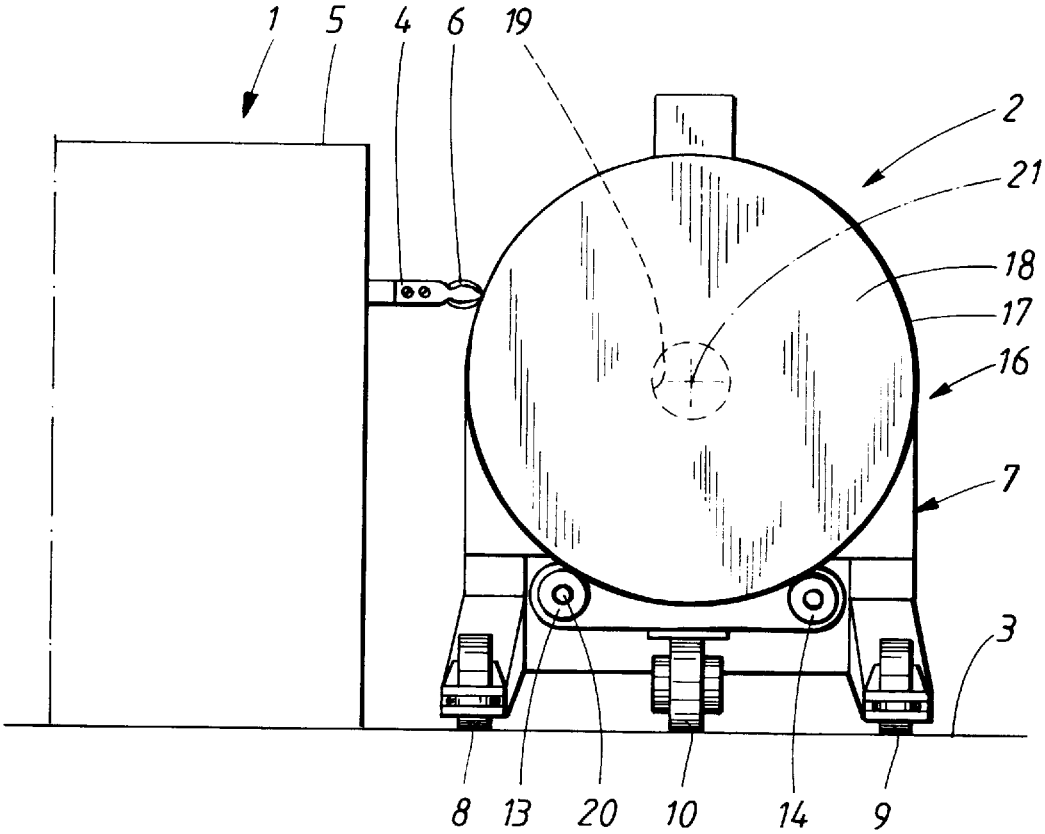

The device according to the invention, in a developed embodiment, can consist of a stationary unit 1 and a mobile unit 2. The stationary unit is formed from a stationary cutting device which is fixedly attached onto a floor 3 and supports a cutting tool in the form of a knife unit 4, which projects sidewardly from a stand with a control and drive unit 5 for the cutting device 1. The knife unit 4 is for instance movably arranged relative to the control and drive unit 5 for giving controlled movement between a retracted position, for example retracted to a hidden position inside the unit 5, and a projecting cutting position shown in FIG. 2 and possibly also movable sideways, i.e. essentially horizontally. The cutting edge 6 of the knife unit extends preferably in a vertical plane or at a small angle to this.

The mobile unit 2 is built like a mobile load carrier, for example like a so-called auto carrier i.e. a self-driven self-controlled load vehicle which moves between determined positions. The vehicle can either follow a predetermined path, choose between several different predetermined paths or be programmed to choose by itself suitable routes between stations. The freedom of movement of the mobile unit is dependent on the chosen technique for controlling the unit. A commonly occurring control technique is based on fixedly inlaid control loops in the floor, whilst a more flexible solution is constituted by a previously known navigation system which is based on a rotating laser carried by the vehicle, which detects the reflections from fixed reflection points in the premises. By measuring the laser beam's angle relative to a reference line in the horizontal plane during reflection from at least two reflection points, the position can be determined and the vehicle controlled according to a chosen path by means of control equipment.

The mobile unit 2 is made up of a wagon 7 with at least three wheels 8, 9 and 10, of which at least one constitutes a steering wheel which is controlled by means of the automatic control equipment. The steering wheel 10 or any of the other wheels 8, 9 serve(s) as a drive wheel which is driven by a drive motor for displacement of the wagon 7 with the desired speed and for starting and stopping in chosen positions. The wagon presents a lifting device 11 in the form of a so-called forklift in which the lifting device is designed as a raisable and lowerable unit, movable along a guide 12. The lifting device 11 presents two lifting and carrying members 13, 14, which are formed by two carrying rollers. These form a rotation device and are therefore rotatably carried in the part of the lifting device which is formed by a vertical crab 15 which by means of a non-depicted drive mechanism is movable vertically along the guide 12. The carrying rollers 13, 14 thereby form, in the shown example, fork legs positioned essentially parallel to each other and at a suitable respective distance such that they can support and rotate a roll 16 of continuous material web, e.g. paper. The roll is essentially cylindrical with a cylindrical outer surface 17 and two end faces 18. The roll normally presents a central core 19 in the form of a tube on which the material web is rolled up. The roll 16 is completely or partially enclosed in a protective layer which surrounds at least the end faces 18 and is normally made from a layer of strong paper. The protective layer can even cover the outer surface 17 completely or partially. The most common form of the protective layer is a sheet of paper attached on each one of the end faces, said sheet of paper being folded with a part over the roll's circular edge 22, 23 and glued against the cylinder outer surface 17. It is normally sufficient that the sheet extends a few centimeters over onto the cylindrical surface.

The carrying rollers 13, 14 present a suitable, relatively small diameter and necessary length in order to be able to be inserted on either side of the support surface of the material roll on a base. It is realised that the roll is collected from a level above the base 3, for example on a cradle or similar. The crab 15 can also be arranged such that both carrier rollers 13, 14 are movable sideways with respect to each other, preferably by means of a highly geared drive motor, whereby the carrying rollers can be adapted to different dimensions of material rolls which are to be lifted. The crab 15 further presents a drive motor for rotation of one or both of the carrying rollers 13, 14 so that after activation they can be made to rotate around their longitudinal axle 20 for rotation of the material roll 17 around its geometrical longitudinal axis 21. This rotation can be activated either manually by means of a manoeuvring member on the mobile unit 2 or remotely controlled via control and drive unit 5 or a non-depicted central computer in the material handling system.

The idea with the arrangement according to the invention is thus to remove the protective layer, i.e. the packaging, from the material roll in an efficient manner. In this example it is required that the protective layer should be removed from the end surfaces 18, which occurs in the following manner: The material roll 16 is carried into position by means of the mobile unit 2 from a warehouse, production site or similar, to the cutting position shown in FIG. 2, whereupon the rotation device is activated. This activation can occur shortly before or when the mobile unit 2 is located at the position shown in FIG. 2 close to the cutting device 1, whereby also the knife unit is activated to contact the periphery 17 of the material roll 16 and to penetrate the outer surface at one edge portion 22, 23 at a time. The packaging of the material roll 16 is made of a strong material, for example coarse paper in one or more layers, which thus shall be removed from the roll on the end faces 18 before the material web can be unrolled from this. Cutting open of the packaging by means of the cutting device 1 is achieved when the material roll 16 rotates whilst the knife unit 6 is made to penetrate through the packaging. This occurs with the mobile unit 2 and the knife unit 6 standing still in the position shown in FIG. 2. The knife unit is started and is held as near as possible to the edge portions 22, 23 of the material roll, whereby a purely annular complete cutline is achieved which thus cuts off the packaging over the end part of the roll. After a movement of either the knife unit or the mobile unit in the longitudinal direction of the roll, the knife unit is placed against the other end part, whereafter the roll is rotated and the packaging at the other end face is cut off in a similar manner whereby the protection layer falls down or is removed by hand.

After finishing cutting of the packaging, the mobile unit 2 can be activated in order to move to the next station and thus take with it the material roll without any load transfer procedure.

The invention is not limited to the embodiments described above and shown in the drawings, but can be varied within the scope of the appended claims. For example it is imaginable that the actual driven rotation of the roll occurs by way of drive means which is connected to a drive motor in the stationary unit 1. The drive means can consist of a drive roll which lies against the periphery of the roll or eccentrically against one end surface. A drive axle with engagement means can alternatively be coupled to the centre of the roll. In a simpler embodiment, the stationary unit 1 can be replaced by a person holding a cutting tool such as a knife in a manner which corresponds to that described above, i.e. during rotation of the roll on the mobile unit. In this way any suitable position whatsoever can be chosen for the cutting operation. For cutting of a roll completely or only of the packaging surrounding the outer surface, the knife unit can be made to perform a sideways movement along the roll during its rotation whereby a spiral-formed cutline is obtained and the protective layer can be removed.

In practice the carrier members 13, 14 are made from several shorter rollers which are rotatably carried on the lifting forks of the mobile unit.

I claim:

1. The combination of an apparatus for cutting a protective layer away from an outer surface of a material roll of web-formed material while the material is being conveyed from a storage location to a use location; comprising:

(a) a mobile load carrier adapted for movement over a supporting surface for conveying the material roll, and including guide means for moving and positioning the load carrier and the material roll carried thereon;

(b) a pair of spaced-part axles carried by said mobile load carrier, and having respective proximal ends connected to said mobile load carrier and respective free ends extending away from said mobile load carrier, the free ends of said axles defining respective loading forks adapted for engaging and lifting the material roll upwardly from the supporting surface;

(c) rotation means carried on said mobile load carrier for rotating the material roll, said rotation means including at least two parallel, laterally spaced-apart rotatable carrier rollers positioned on respective ones of said pair of spaced-apart axles for supporting the material roll for rotation thereon, (d) a cutting tool station positioned intermediate said storage location and said use location;

(e) a cutting tool carried by said cutting tool station for engaging the protective layer on the outer surface of the material roll as the rotation means on the mobile load carrier rotates the material roll; and (f) said guide means for moving the material roll to the cutting tool station during transit of the material roll on the mobile load carrier from the storage location to the use location for cutting by the cutting tool of the protective layer on the outer surface of the material roll before the mobile load carrier completes its transit to the use location.

* * * * *